US011160306B2

(12) United States Patent
Daryani

(10) Patent No.: US 11,160,306 B2
(45) Date of Patent: Nov. 2, 2021

(54) ELECTRONIC SMOKING DEVICE HAVING A PUMP MECHANISM

(71) Applicant: Fontem Holdings 1 B.V., Amsterdam (NL)

(72) Inventor: Neha Daryani, Hamburg (DE)

(73) Assignee: Fontem Holdings 1 B.V., Amsterdam (NL)

( * ) Notice: Subject to any disclaimer, the term of this patent is extended or adjusted under 35 U.S.C. 154(b) by 546 days.

(21) Appl. No.: 15/771,760

(22) PCT Filed: Oct. 27, 2016

(86) PCT No.: PCT/EP2016/075945
§ 371 (c)(1),
(2) Date: Apr. 27, 2018

(87) PCT Pub. No.: WO2017/072239
PCT Pub. Date: May 4, 2017

(65) Prior Publication Data

US 2018/0343921 A1 Dec. 6, 2018

(30) Foreign Application Priority Data

Oct. 28, 2015 (EP) ..... 15191936

(51) Int. Cl.

| | |
|---|---|
| ***A24F 13/00*** | (2006.01) |
| ***A24F 17/00*** | (2006.01) |
| ***A24F 25/00*** | (2006.01) |
| ***A24F 40/48*** | (2020.01) |
| ***A24F 7/00*** | (2006.01) |
| ***A24F 40/42*** | (2020.01) |
| ***A24F 40/485*** | (2020.01) |
| ***A24F 40/60*** | (2020.01) |
| ***B05B 1/24*** | (2006.01) |
| *A24F 40/10* | (2020.01) |

(52) U.S. Cl.
CPC ..... *A24F 7/00* (2013.01); *A24F 40/42* (2020.01); *A24F 40/48* (2020.01); *A24F 40/485* (2020.01); *A24F 40/60* (2020.01); *B05B 1/24* (2013.01); *A24F 40/10* (2020.01)

(58) Field of Classification Search
CPC ..... A24F 40/42; A24F 47/008; A24F 47/002; A24F 47/004; A24F 40/48; A24F 40/485
USPC ..... 131/328, 329
See application file for complete search history.

(56) References Cited

U.S. PATENT DOCUMENTS 9,532,597 B2 * 1/2017 Tucker ..... A24F 47/008
2013/0199528 A1 8/2013 Goodman et al.
(Continued)

FOREIGN PATENT DOCUMENTS

WO 2014153515 A1 9/2014

*Primary Examiner* — Hae Moon Hyeon
(74) *Attorney, Agent, or Firm* — Dykema Gossett PLLC

(57) ABSTRACT

An electronic smoking device is provided comprising a housing with a mouthpiece portion and a heating element arranged within the housing. Furthermore, the electronic smoking device comprises a liquid reservoir adapted to receive a base liquid therein. Moreover, the electronic smoking device further comprises a pump mechanism that is adapted to provide at least a part of the base liquid within the liquid reservoir onto the heating element upon an actuation of the pump mechanism in a fully assembled state of the electronic smoking device.

17 Claims, 5 Drawing Sheets

(56) References Cited

U.S. PATENT DOCUMENTS

| | | | | |
|---|---|---|---|---|
| 2013/0213418 | A1* | 8/2013 | Tucker | A24F 40/51 131/328 |
| 2013/0292857 | A1* | 11/2013 | Connors | B01F 3/04241 261/30 |
| 2014/0096782 | A1 | 4/2014 | Ampolini et al. | |
| 2014/0261492 | A1* | 9/2014 | Kane | A24F 47/008 131/328 |
| 2014/0290650 | A1* | 10/2014 | Ivey | A24F 47/008 128/202.21 |
| 2015/0020822 | A1* | 1/2015 | Janardhan | A61M 11/042 131/328 |
| 2015/0027454 | A1* | 1/2015 | Li | A61M 11/044 131/328 |
| 2015/0027456 | A1 | 1/2015 | Janardhan et al. | |
| 2015/0313275 | A1* | 11/2015 | Anderson | A24B 15/10 131/352 |
| 2015/0374039 | A1* | 12/2015 | Zhu | A24F 47/008 131/329 |
| 2017/0172210 | A1* | 6/2017 | Bright | H05B 1/0244 |
| 2017/0280776 | A1* | 10/2017 | Manca | H05B 3/04 |

* cited by examiner

ELECTRONIC SMOKING DEVICE HAVING A PUMP MECHANISM

FIELD OF INVENTION

The present invention relates generally to electronic smoking devices and in particular electronic cigarettes.

BACKGROUND OF THE INVENTION

An electronic smoking device, such as an electronic cigarette (e-cigarette), typically has a housing accommodating an electric power source (e.g. a single use or rechargeable battery, electrical plug, or other power source), and an electrically operable atomizer with a heating element. The atomizer vaporizes or atomizes liquid supplied from a reservoir and provides vaporized or atomized liquid as an aerosol. Control electronics control the activation of the atomizer. In some electronic cigarettes, an airflow sensor is provided within the electronic smoking device which detects a user puffing on the device (e.g., by sensing an underpressure or an air flow pattern through the device). The airflow sensor indicates or signals the puff to the control electronics to power up the device and generate vapor. In other e-cigarettes, a switch is used to power up the e-cigarette to generate a puff of vapor.

Recent studies and polls have shown that for many users the joy of consumption of an electronic smoking device is significantly increased when some of the liquid usually contained within the reservoir is directly provided onto the heating element of the atomizer. Such a direct provision of liquid enhances the vapor production and the taste of the aerosol generated by the atomizer. However, such a direct application of the liquid has to be manually performed prior to consumption while the electronic smoking device needs to be disassembled, using a pipette or an equivalent thereof. Such a procedure is complicated, time-consuming and can spoil the enjoyment of puffing on the device.

SUMMARY OF THE INVENTION

In accordance with one aspect of the present invention there is provided an electronic smoking device comprising a housing with a mouthpiece portion and a heating element arranged within the housing. Furthermore, the electronic smoking device comprises a liquid reservoir adapted to receive a base liquid therein. Moreover, the electronic smoking device further comprises a pump mechanism adapted to provide at least a part of the base liquid within the liquid reservoir onto the heating element upon a manual actuation of the pump mechanism in a fully assembled state of the electronic smoking device.

An advantage of such an electronic smoking device may be that the vapor production of the same is improved and the taste of the aerosol produced is intensified without that a complicated application of base liquid onto the heating element in a disassembled state of the electronic smoking device is necessary. In more detail, the pump mechanism of the presented electronic smoking device allows to supply base liquid from the liquid reservoir onto the heating element without passing a wick or another capillary element in a fully assembled and closed state of the electronic smoking device and during the usage of the same.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

DESCRIPTION OF THE PREFERRED EMBODIMENTS

Figure 1:
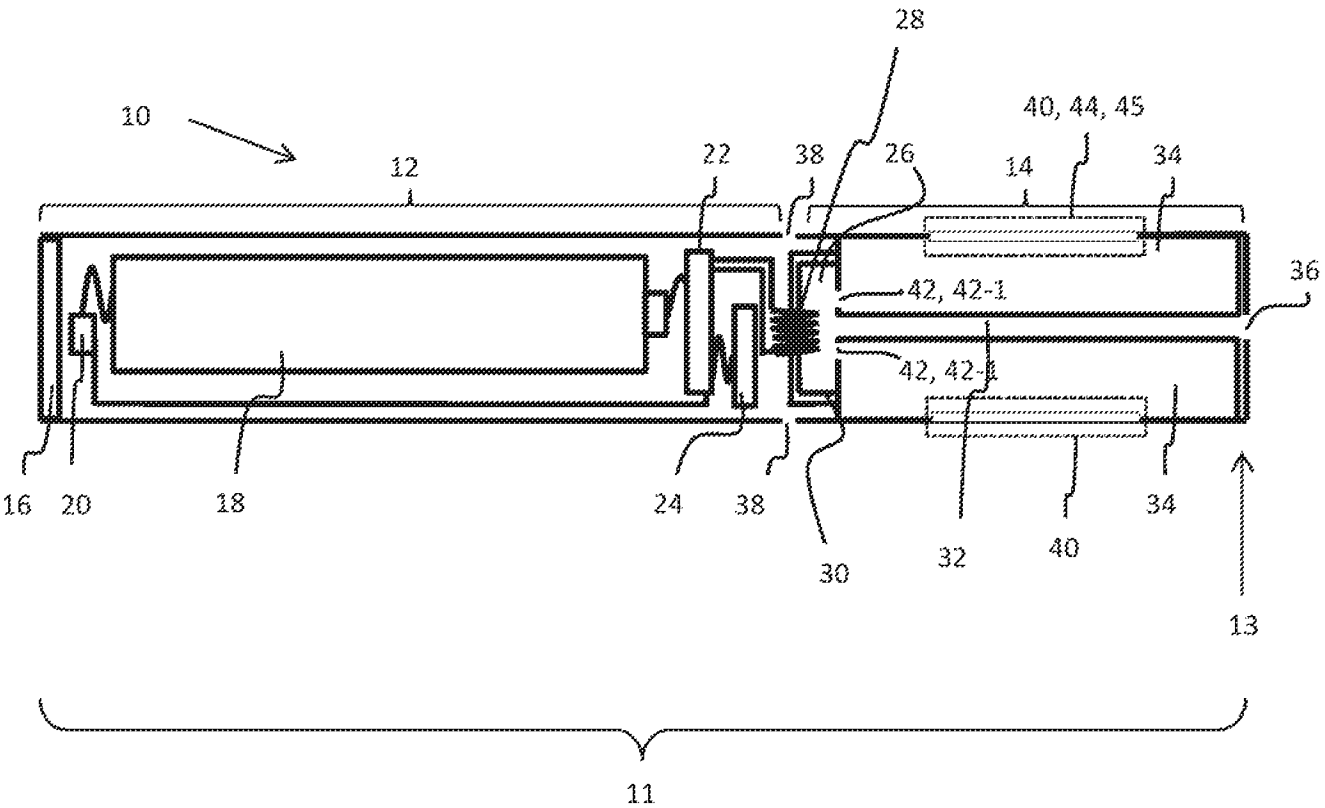
FIG. 1 is a schematic cross-sectional illustration of a first embodiment of an electronic smoking device according to the invention.

Throughout the following, a first embodiment of the electronic smoking device 10 will be exemplarily described with reference to an e-cigarette. As is shown in FIG. 1, an e-cigarette 10 typically has a housing 11 with a mouthpiece portion 13 as a part of the same. In more detail, the housing 11 comprises a cylindrical hollow tube having an end cap 16. The cylindrical hollow tube may be a single piece or a multiple piece tube. In FIG. 1, the cylindrical hollow tube is shown as a three piece structure having a battery portion 12, an atomizer/liquid reservoir portion 14 with a liquid reservoir 34 and the mouthpiece portion 13. The liquid reservoir 34 is adapted to receive a base liquid therein which is adapted to be vaporized/atomized into a consumable aerosol. Together the battery portion 12 and the atomizer/liquid reservoir portion 14 form a cylindrical tube which is approximately the same size and shape as a conventional cigarette, typically about 100 mm with a 7.5 mm diameter, although lengths may range from 70 to 150 or 180 mm, and diameters from 5 to 20 mm. The liquid reservoir 34 can also be adapted to receive any other consumable liquid, which further can comprise certain flavors or the like.

The mouthpiece portion 13 may be removable from the main body, or the mouthpiece portion 13 may be part of, or integral with, the main body. In embodiments where the mouthpiece portion 13 is a component separate from the main body, the mouthpiece portion 13 may be attached to the main body via a friction push fit, a snap fit, a bayonet attachment or screw threads. In a further aspect, the main body and the mouthpiece portion 13, in whichever form provided, together comprise an electronic smoking device 10 which is approximately the same size and shape as a conventional tobacco cigarette, typically about 100 mm with a 7.5 mm diameter, although lengths may range from 70 to 150 or 180 mm, and diameters from 5 to 20 mm.

The battery portion 12 and atomizer/liquid reservoir portion 14 are typically made of steel or hardwearing plastic and act together with the end cap 16 to provide a housing to contain the components of the e-cigarette 10. The battery portion 12 and an atomizer/liquid reservoir portion 14 may be configured to fit together by a friction push fit, a snap fit, or a bayonet attachment, magnetic fit, or screw threads. The end cap 16 is provided at the front end of the battery portion 12 while the mouthpiece portion 13 is provided at the back end of the atomizer/liquid reservoir portion 14. The end cap 16 may be made from translucent plastic or other translucent material to allow an LED 20 positioned near the end cap 16 to emit light through the end cap 16. The end cap 16 can be made of metal or other materials that do not allow light to pass.

An air inlet may be provided in the end cap, at the edge of the inlet next to the cylindrical hollow tube, anywhere along the length of the cylindrical hollow tube, or at the connection of the battery portion 12 and the atomizer/liquid reservoir portion 14. FIG. 1 shows a pair of air inlets 38 provided at the intersection between the battery portion 12 and the atomizer/liquid reservoir portion 14.

A battery 18, a light-emitting diode (LED) 20, control electronics 22 and optionally an airflow sensor 24 are provided within the cylindrical hollow tube battery portion 12. The battery 18 is electrically connected to the control electronics 22, which are electrically connected to the LED 20 and the airflow sensor 24. In this example the LED 20 is at the front end of the battery portion 12, adjacent to the end cap 16 and the control electronics 22 and airflow sensor 24 are provided in the central cavity at the other end of the battery 18 adjacent the atomizer/liquid reservoir portion 14.

The airflow sensor 24 acts as a puff detector, detecting a user puffing or sucking on the mouthpiece portion 13 and thereby on the atomizer/liquid reservoir portion 14 of the e-cigarette 10. The airflow sensor 24 can be any suitable sensor for detecting changes in airflow or air pressure such as a microphone switch including a deformable membrane which is caused to move by variations in air pressure. Alternatively the sensor may be a Hall element or an electro-mechanical sensor.

The control electronics 22 are also connected to an atomizer 26. In the example shown, the atomizer 26 includes a heating element 28 which in this embodiment is realized as a heating coil which is wrapped around a wick 30 and arranged within the housing 11. The heating element 28 and the wick 30 are arranged in front of a central passage 32 of the atomizer/liquid reservoir portion 14. The heating element or coil 28 may be positioned anywhere in the atomizer 26 and may be transverse or parallel to the liquid reservoir 34. The wick 30 and the heating element 28 do not completely block the central passage 32. Rather an air gap is provided between the heating element 28 and the atomizer/liquid reservoir portion 14, enabling air to flow past the heating element 28 and the wick 30. The atomizer 26 may alternatively use other forms of heating elements, such as ceramic heaters, or fiber or mesh material heaters. Nonresistance heating elements such as sonic, piezo and jet spray may also be used in the atomizer in place of the heating element 28.

In this first embodiment, the liquid reservoir 34 is realized as a hollow cylinder with a closed volume, provided between an inner and an outer radius. The liquid reservoir 34 has the cross section of an annulus and comprises a bottom sidewall which is facing towards the battery portion 12 and a top sidewall which is facing towards the mouthpiece portion 13. The wick 30 pierces through the bottom sidewall of the liquid reservoir 34 on a first and a second point of the area of the same, allowing base liquid within the liquid reservoir 34 to flow from the first point to the second point through the wick 30. Expressed in other words, the central passage 32 is surrounded by a cylindrical liquid reservoir 34 with the ends of the wick 30 abutting or extending into the liquid reservoir 34. The wick 30 may be a porous material such as a bundle of fiberglass fibers, with liquid in the liquid reservoir 34 drawn by capillary action from the ends of the wick 30 towards the central portion of the wick 30 encircled by the heating element 28.

The liquid reservoir 34 may alternatively include wadding soaked in liquid which encircles the central passage 32 with the ends of the wick 30 abutting the wadding. In other embodiments the liquid reservoir 34 may comprise a toroidal cavity arranged to be filled with liquid and with the ends of the wick 30 extending into the toroidal cavity.

An air inhalation port 36 is provided within the mouthpiece portion 13 at the back end of the atomizer/liquid reservoir portion 14 remote from the end cap 16. The inhalation port 36 may be formed from the cylindrical hollow tube atomizer/liquid reservoir portion 14.

In use, a user sucks on the e-cigarette 10. This causes air to be drawn into the e-cigarette 10 via one or more air inlets, such as air inlets 38 and to be drawn through the central passage 32 towards the air inhalation port 36. The change in air pressure which arises is detected by the airflow sensor 24 which generates an electrical signal that is passed to the control electronics 22. In response to the signal, the control electronics 22 activate the heating element 28 which causes liquid present in the wick 30 to be vaporized creating an aerosol (which may comprise gaseous and liquid components) within the central passage 32. As the user continues to suck on the e-cigarette 10, this aerosol is drawn through the central passage 32 and inhaled by the user. At the same time the control electronics 22 also activate the LED 20 causing the LED 20 to light up which is visible via the translucent end cap 16 mimicking the appearance of a glowing ember at the end of a conventional cigarette. As liquid present in the wick 30 is converted into an aerosol more liquid is drawn into the wick 30 from the liquid reservoir 34 by capillary action and thus is available to be converted into an aerosol through subsequent activation of the heating element 28.

Some e-cigarettes are intended to be disposable and the electric power in the battery 18 is intended to be sufficient to vaporize the liquid contained within the liquid reservoir 34 after which the e-cigarette 10 is thrown away. In other embodiments, the battery 18 is rechargeable and the liquid reservoir 34 is refillable. In the cases where the liquid reservoir 34 is a toroidal cavity, this may be achieved by refilling the liquid reservoir 34 via a refill port. In other embodiments the atomizer/liquid reservoir portion 14 of the e-cigarette 10 is detachable from the battery portion 12 and a new atomizer/liquid reservoir portion 14 can be fitted with a new liquid reservoir 34 thereby replenishing the supply of liquid. In some cases, replacing the liquid reservoir 34 may involve replacement of the heating element 28 and the wick 30 along with the replacement of the liquid reservoir 34. A replaceable unit comprising the atomizer 26 and the liquid reservoir 34 is called a cartomizer.

The new liquid reservoir 34 may be in the form of a cartridge having a central passage 32 through which a user inhales aerosol. In other embodiments, aerosol may flow around the exterior of the central passage 32 to an air inhalation port 36.

Furthermore, the electronic smoking device 10 comprises a pump mechanism 40 which is adapted to provide at least a part of the base liquid within the liquid reservoir 34 onto the heating element 28 upon an actuation of the pump mechanism 40 in a fully assembled state of the electronic smoking device 10. An advantage of such an electronic smoking device 10 may be that the vapor production is ameliorated and the taste of the aerosol produced is intensified without that a complicated application of base liquid onto the heating element 28 in a disassembled state of the electronic smoking device 10 is necessary. In more detail, the pump mechanism 40 of the presented electronic smoking device 10 allows to supply base liquid from the liquid reservoir 34 onto the heating element 28 in a fully assembled and closed state of the electronic smoking device 10 and during the usage of the same. Expressed in other words, such a pump mechanism 40 allows to squirt base liquid arranged within the liquid reservoir 34 onto the heating element 28 and on the wick 30 during the use of the electronic smoking device 10 in a fully assembled state of the same, where the squirted base liquid directly travels from the reservoir 34 to the heating element without travelling through the wick 30.

In this first embodiment of the invention, the cylindrical liquid reservoir 34 exemplarily has two outlet elements 42 which are adapted to permeate base liquid when the pressure within the liquid reservoir 34 surpasses a predefined level of pressure. In this first embodiment, the predefined level of pressure is equal to a predefined difference in the pressure given within the liquid reservoir 34 and the ambient pressure. An advantage of that may be that it is assured that base liquid is only provided from the liquid reservoir onto the heating element upon an actuation of the pump mechanism 40, which prevents an undesired leakage of base liquid.

The outlet elements 42 are realized within the bottom sidewall of the liquid reservoir 34 directly facing the heating element 28 and the wick 30. Expressed in other words, the outlet elements 42 are arranged adjacent the wick 30 and the heating element 28, so that base liquid exiting the liquid reservoir 34 is directly squirted on the heating element 28 and the wick 30 upon the actuation of the pump mechanism 40. The outlet elements 42 are arranged within an end of the liquid reservoir 34 opposing the end of the liquid reservoir 34 which is arranged adjacent to the mouthpiece portion 13. In other words, at least part of the base liquid reaches the heating element 28 (and the wick 30) without being drawn through the wick 30 by a capillary force.

In this first embodiment, the outlet elements 42 are realized as holes 42-1 within the bottom sidewall of the liquid reservoir 34 and have a diameter that is adjusted such that liquid is contained within the liquid reservoir 34 as long as the pressure therein is smaller than the predefined level of pressure. Therefore, the diameter of the holes 42-1 corresponds to the physical and chemical characteristics of the base liquid. In this first embodiment, the predefined level of pressure is equal to a predefined difference in the pressure given within the liquid reservoir 34 and the ambient pressure. However, in other embodiments, other outlet elements 42 as for example pressure sequence valves can be used.

In this first embodiment of the invention, the pump mechanism 40 comprises a manual pump 44 which can be exemplarily activated by a user performing a pinch movement only using two or more fingers. The pump mechanism 40 in this embodiment exemplarily comprises two squeezable and flexible components 45, which are adapted to increase the pressure within the liquid reservoir 34 and to cause a reduction of the volume of the liquid reservoir 34 when squeezed. In more detail, the squeezable and flexible components 45 which form the substantial part of the manual pump 44 are realized as a part of the liquid reservoir 34 and the housing 11. The squeezable and flexible components 45 represent a part of the outer wall of the liquid reservoir 34 and the housing 11 of the electronic smoking device 10, separating the inside of the electronic smoking device 10 from the outside of the same. In other words, the squeezable and flexible components 45 form a part of the housing 11 and are accessible from an outside of the electronic smoking device 10 respectively. Expressed in other words again, the squeezable and flexible components 45 form a part of the housing 11 and are accessible from an outside of the electronic smoking device 10 respectively when the electronic smoking device 10 is fully assembled. An advantage of that may be that the squeezable and flexible components 45 are easily accessible and the pump mechanism 40 can easily be actuated. Furthermore, the squeezable and flexible components 45 are also components of the liquid reservoir 34, since in this first embodiment of the invention, the respective wall of the housing 11 also forms one of the sidewalls of the liquid reservoir 34. An advantage of that may be that an increase of the pressure within the liquid reservoir 34 can easily be achieved by a deformation of the liquid reservoir 34 itself. Furthermore, this allows to easily exchange the pump mechanism 40 together with the liquid reservoir 34. In this first embodiment of the invention, the squeezable and flexible components 45 are made of a rubber. However, the squeezable and flexible components 45 can also be made of any other flexible and squeezable material.

In use, a user of the electronic smoking device 10 can actuate the manual pump 44 by squeezing the squeezable and flexible components 45, for example with a pinch movement performed by two fingers, thereby squirting base liquid contained within the liquid reservoir 34 onto the heating element 28 and the wick 30. The base liquid squirted on the heating element 28 or the wick 30 nearby the heating element 28 is vaporized by the heating element 28. This intensifies the taste of the aerosol consumed.

Of course, in addition to the above description of the structure and function of a typical e-cigarette 10, variations also exist. For example, the LED 20 may be omitted. The airflow sensor 24 may be placed adjacent the end cap 16 rather than in the middle of the e-cigarette. The airflow sensor 24 may be replaced with a switch which enables a user to activate the e-cigarette manually rather than in response to the detection of a change in air flow or air pressure.

Different types of atomizers may be used. Thus for example, the atomizer may have a heating coil in a cavity in the interior of a porous body soaked in liquid. In this design aerosol is generated by evaporating the liquid within the porous body either by activation of the coil heating the porous body or alternatively by the heated air passing over or through the porous body. Alternatively the atomizer may use a piezoelectric atomizer to create an aerosol either in combination or in the absence of a heater.

Figure 2:
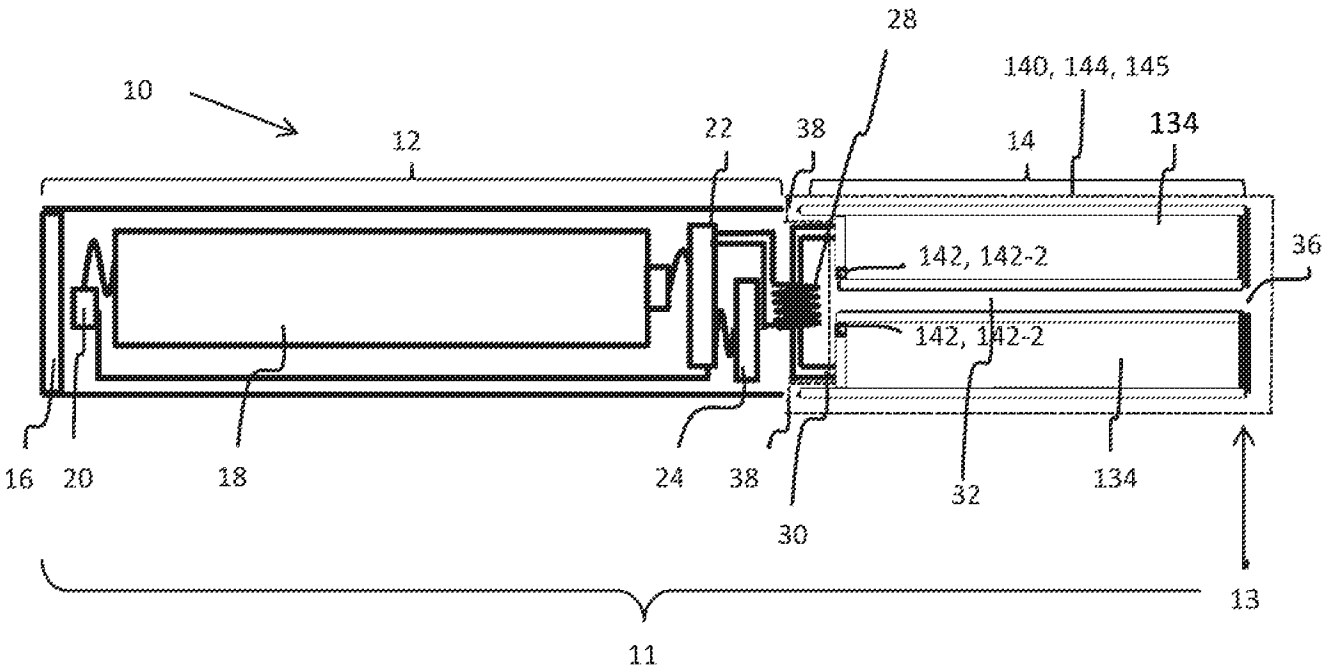
FIG. 2 is a schematic cross-sectional illustration of a second embodiment of an electronic smoking device according to the invention.

In FIG. 2, a schematic cross-sectional illustration of a second embodiment of an electronic smoking device 10 is shown. The electronic smoking device 10 shown in FIG. 2 is substantially identical to the electronic smoking device 10 as shown in FIG. 1. Therefore, the reference signs in FIG. 2 which are identical to the respective reference signs shown in FIG. 1 denote equal components for which the description as given above applies.

The electronic smoking device 10 as shown in FIG. 2 differs from the electronic smoking device 10 as shown in FIG. 1 mainly in the pump mechanism 140. In this second embodiment of the invention, the electronic smoking device 10 also comprises a pump mechanism 140 with a manual pump 144. However, in this second embodiment of the invention, the manual pump 144 does not solely comprise two separate squeezable and flexible components 145, but the whole liquid reservoir 134 is configured flexible and squeezable. An advantage of that may be that the pressure on the base liquid within the liquid reservoir 134 can be increased, since the liquid reservoir 134 can be compressed to a higher degree.

Expressed in other words, in this second embodiment of the invention, all the walls of the liquid reservoir 134 represent squeezable and flexible components 145 with a highly alterable geometrical shape. In this second embodiment, only the mouthpiece portion 13 is rigid, stable and not flexible or squeezable, so that the liquid reservoir 134 can be for example compressed along its length up to the mouthpiece portion 13. In this second embodiment of the electronic smoking device 10, the liquid reservoir 134 is exemplarily made of an elastic polymer. However, it also can be made of any other elastic, flexible and squeezable material.

Also in this second embodiment of the invention, the liquid reservoir 134 comprises two outlet elements 142 which are exemplarily realized as pressure sequence valves 142-2. An advantage of such pressure sequence valves may be that they allow a precise adjustment of the predefined level of pressure which needs to be surpassed for a provision of the base liquid from the liquid reservoir 134. The outlet elements 142 are arranged within the bottom sidewall of the liquid reservoir 134, directly facing the heating element 28 and the wick 30. Expressed in other words, the outlet elements 142 are arranged such within the bottom sidewall of the liquid reservoir 134 that the distance between the liquid reservoir 134 and the heating element 28 is minimal. However, it is also possible to realize electronic smoking devices 10 according to the invention which have other outlet elements 142 at other positions within the electronic smoking device 10. In this second embodiment of the invention, the wick 30 is also configured flexible and squeezable and is strongly fixed to the liquid reservoir 134 itself. In some embodiments, the wick 30 and the liquid reservoir 134 are produced as a single-piece component. However, also other constructions are possible. In use, base liquid flows from the liquid reservoir 134 through the wick 30 where a small fraction of the same exits the wick 30 through its pours in order to be vaporized by the heating element 28. The vaporized base liquid or in other words the base liquid which is transformed into an aerosol, streams through the central passage 32 of the liquid reservoir 134 and exits the electronic smoking device 10 via the air inhalation port 36 within the mouthpiece portion 13. When the user of the electronic smoking device 10 wishes to intensify the taste of the aerosol consumed, he or she can simply compress the liquid reservoir 134, thereby increasing the pressure on the base liquid given within the liquid reservoir 134. An increase in pressure which surpasses a predefined level of pressure will cause the pressure sequence valves 142-2 to become permeable so that base liquid within the liquid reservoir 134 will be squirted directly onto the heating element 28. This will cause an instant vaporisation of the additional base liquid that is squirted out of the liquid reservoir 134, intensifying the taste of the aerosol consumed.

Figure 3:
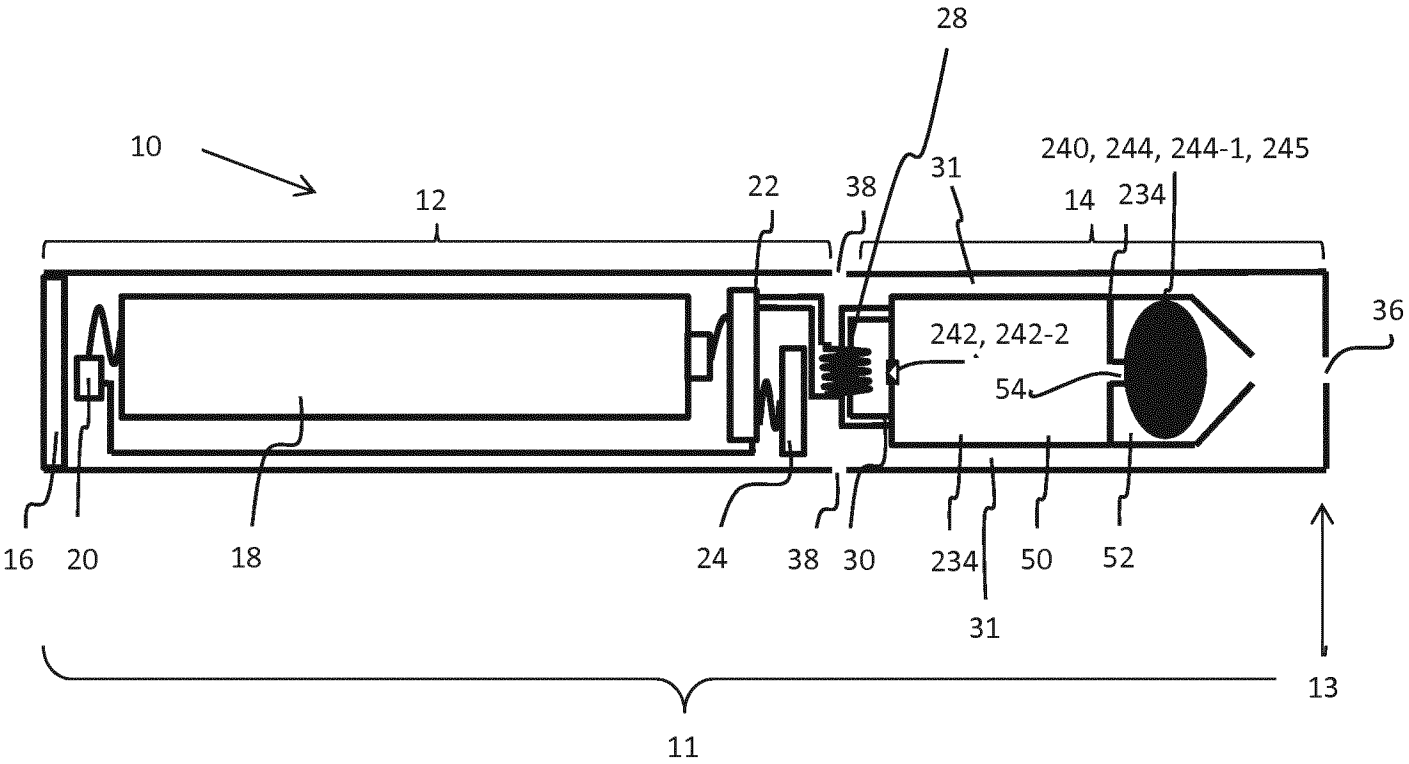
FIG. 3 is a schematic cross-sectional illustration of a third embodiment of an electronic smoking device according to the invention.

FIG. 3 shows a schematic cross-sectional illustration of a third embodiment of an electronic smoking device 10 according to the invention. The electronic smoking device 10 shown in FIG. 3 is substantially identical to the electronic smoking device 10 as shown in FIGS. 1 and 2. Therefore, the reference signs in FIG. 3 which are identical to the respective reference signs shown in FIGS. 1 and 2 denote equal components for which the description as given above. The electronic smoking device 10 as shown in FIG. 3 differs from the electronic smoking devices 10 shown in FIGS. 1 and 2 mainly in the construction of the liquid reservoir 234 and the pump mechanism 240. In this third embodiment of the invention, the liquid reservoir 234 exemplarily has the shape of a cylinder which has a conical section instead of a top sidewall. The liquid reservoir 234 is arranged centrally within the atomizer/liquid reservoir portion 14, so that vaporized base liquid flows from the heating element 28 around the liquid reservoir 234 through an air passage 31 to the air inhalation port 36 within the mouthpiece portion 13. The liquid reservoir 234 is made of a rigid material which is not flexible or squeezable. In this third embodiment of the invention, a single outlet element 242 is arranged within the bottom sidewall of the liquid reservoir 234, directly facing the heating element 28. It is arranged within the center of the bottom sidewall of the liquid reservoir 234 and realized as a pressure sequence valve 242-2. In this third embodiment of the invention, the liquid reservoir 234 exemplarily comprises a first and a second compartment 50, 52 which are interconnected via a channel 54. While the base liquid is received by the first compartment 50, the second compartment 52 and the channel 54 are suited for the reception of a manual pump 244 which will be described further hereinafter. However, also other kinds of liquid reservoirs 234 can be realized with other outlet elements 242, other geometrical shapes and in other positions within the housing 11 of the electronic smoking device 10.

In this third embodiment of the invention, the pump mechanism 240 is fully arranged within the housing 11 and adapted to increase the pressure within the liquid reservoir 234 upon an actuation of the pump mechanism 240. An advantage of that may be that the electronic smoking device 10 has a compact design and allows to squirt base liquid from the liquid reservoir 234 onto the heating element 28 without a disassembling of the electronic smoking device 10 being necessary. Also in this third embodiment of the invention, the pump mechanism 240 comprises the manual pump 244 so that the pump mechanism 240 advantageously is independent from an external or an internal energy source. The pump mechanism 240 also comprises a squeezable and flexible component 245, adapted to increase the pressure within the liquid reservoir 234 when squeezed. The squeezable and flexible component 245 is a squeezable hollow ball of a manual ball pump 244-1 which is fully arranged within the second compartment 52 of the liquid reservoir 234. Expressed in other words, the squeezable ball of the manual ball pump 244-1 is fully enclosed within the housing 11 of the electronic smoking device 10. An advantage of that may be that the electronic smoking device 10 has a robust and stable design. A connector of the squeezable hollow ball and therefore of the manual ball pump 244-1 is air-tightly connected to the channel 54 between the first and the second compartment 50, 52 within the liquid reservoir 234, allowing to blow air from the squeezable hollow ball of the manual ball pump 244-1 into the first compartment 50 of the liquid reservoir 234 upon an actuation of the manual ball pump 244-1. When the manual ball pump 244-1 is actuated, the pressure within the first compartment 50 of the liquid reservoir 234 is increased and the base liquid from the first compartment 50 is squirted via the outlet element 242 onto the heating element 28.

In order to be able to actuate the manual ball pump 244-1, the squeezable hollow ball of the manual ball pump 244-1 has to be accessible from an outside of the electronic smoking device 10. Therefore, in some embodiments of the invention, the housing 11 of an electronic smoking device 10 can have at least one opening (not shown) through which at least a part of the squeezable and flexible component 245, so of the squeezable hollow ball is accessible from an outside of the electronic smoking device 10. In such embodiments, the squeezable hollow ball of the manual ball pump 244-1 can be compressed through the openings 26 within the housing 11 of the electronic smoking device 10. The housing 11 of the electronic smoking device 10 for example can have two openings on opposing sides of the housing 11 of the electronic smoking device 10, allowing to compress the squeezable hollow ball e. g. with a pinch movement performed by two fingers of a user's hand.

However, in this third embodiment of the invention, the housing 11 of the electronic smoking device 11 exemplarily has two openings (not shown) on opposing sides of the housing 11 with push-buttons (not shown) therein which are adapted to deform the squeezable and flexible component 245, so the squeezable hollow ball of the manual ball pump 244-1 upon an actuation of the push-buttons from an outside of the electronic smoking device 10. An advantage of that may be that the electronic smoking device 10 has a handy design and the pump mechanism 240 can easily be actuated. This aspect will be described in more detail with respect to FIG. 4.

Figure 4:
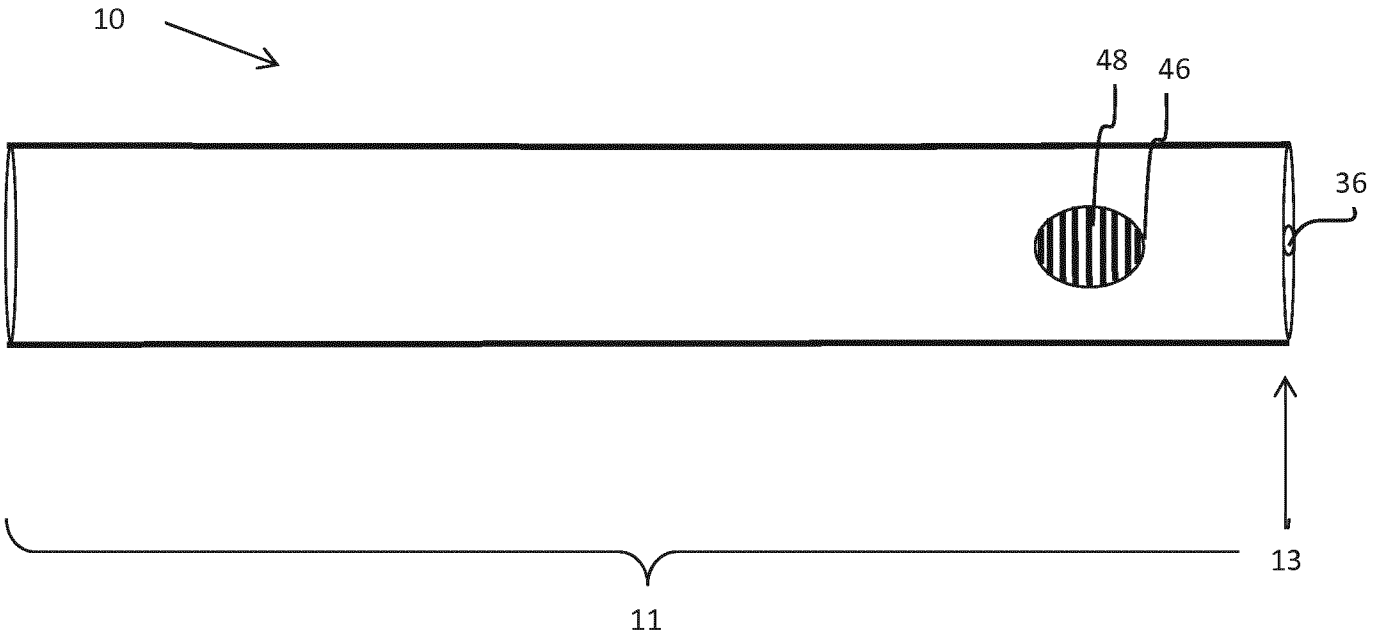
FIG. 4 is an exterior view on the third embodiment of an electronic smoking device according to the invention.

FIG. 4 shows an exterior view on the third embodiment of an electronic smoking device 10 according to the invention. In FIG. 4, the third embodiment of the electronic smoking device 10 is shown in a closed state from an exterior perspective. The positioning of the mouthpiece portion 13 with the air inhalation port 36 therein indicates the orientation of the electronic smoking device 10. In FIG. 4, one of the two push-buttons 48 is shown which is arranged in an opening 46 that is positioned within the housing 11 of the electronic smoking device 10, directly above the squeezable hollow ball of the manual ball pump 44-1. The other push-button 48 in the other opening 46 on an opposing side of the housing 11 is not visible in FIG. 4. In use, a user can intensify the taste of the aerosol consumed by simultaneously pushing the two push-buttons 48 into the electronic smoking device 10, thereby squeezing the hollow ball of the manual ball pump 44-1. This will increase the pressure within the first compartment 50 of the electronic smoking device 10 which will then cause base liquid from the first compartment 50 of the liquid reservoir 34 to be squirted onto the heating element 28. However, also other mechanisms for the compression of the squeezable hollow ball may be realized within an electronic smoking device 10.

Figure 5:
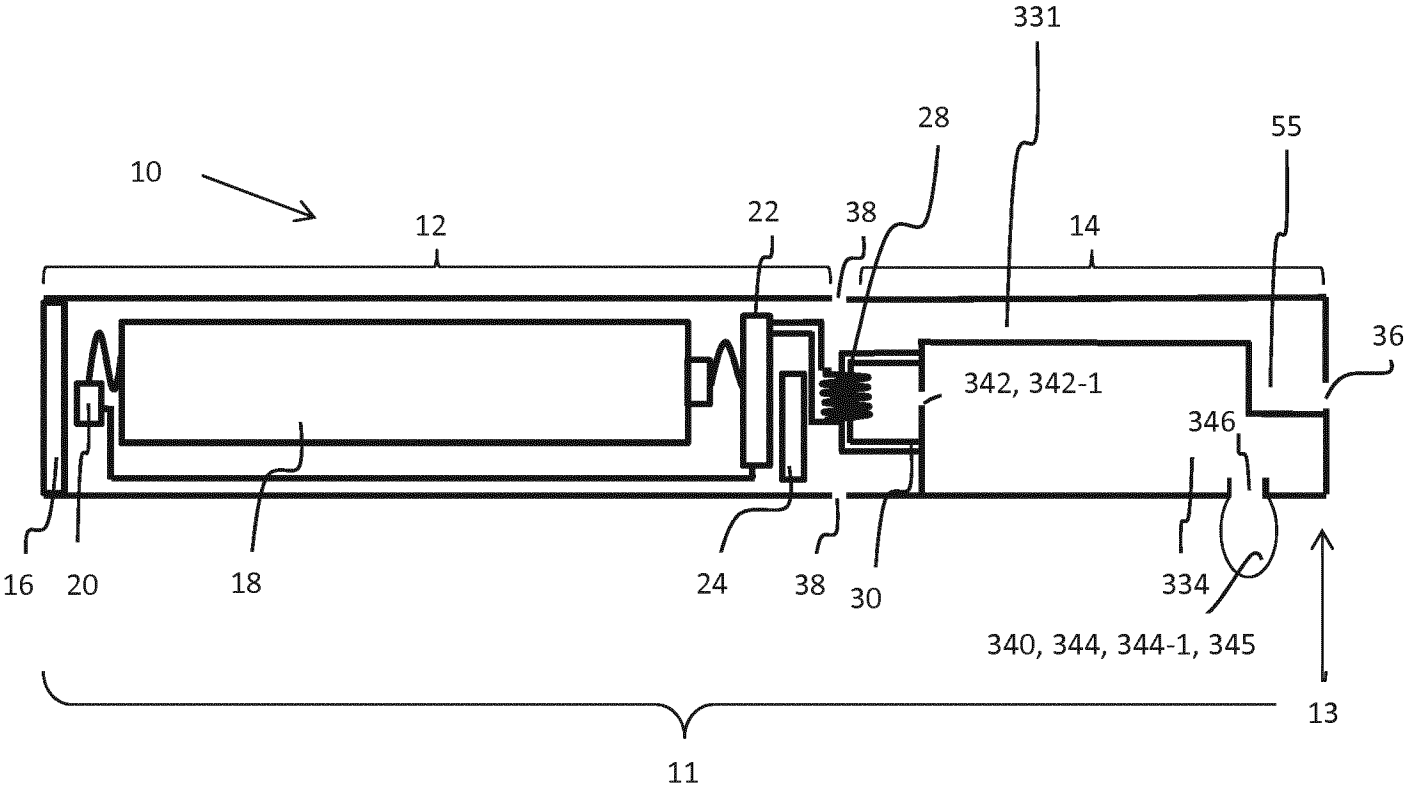
FIG. 5 is a schematic cross-sectional illustration of a fourth embodiment of an electronic smoking device according to the invention.

FIG. 5 is a schematic cross-sectional illustration of a fourth embodiment of an electronic smoking device 10 according to the invention. The electronic smoking device 10 shown in FIG. 5 is substantially identical to the electronic smoking device 10 as shown in FIG. 3. Therefore, the reference signs in FIG. 5 which are identical to the respective reference signs shown in FIG. 3 denote equal components for which the description as given above applies. The electronic smoking device 10 as shown in FIG. 5 differs from the electronic smoking device 10 shown in FIG. 3 mainly in the construction of the liquid reservoir 334 and the pump mechanism 340. In this fourth embodiment of the invention, the liquid reservoir 334 is not separated into different compartments and is not arranged within the center of the housing 11. Instead, the liquid reservoir 334 extends along a fraction of the sidewall of the atomizer/liquid reservoir portion 14 of the housing 11 of the electronic smoking device 10, wherein the respective sidewall also represents a sidewall of the liquid reservoir 334 itself. The liquid reservoir 334 is arranged such within the housing 11 of the electronic smoking device 10, that vaporized base liquid, or aerosol, flows from the heating element 28 through an air passage 331 which is enclosed within the housing 11 in between a sidewall of the housing 11 and the liquid reservoir 334, to the air inhalation port 36. The liquid reservoir 334 has a cut out corner 55 close to the air inhalation port 36 allowing aerosol to flow out of the air inhalation port 36 without being inhibited by the liquid reservoir 334. An outlet element 342 is arranged within the bottom sidewall of the liquid reservoir 334, close to the center of the housing 11 of the electronic smoking device 10. The outlet element 342 is exemplarily realized as a hole 342-1 which has a diameter that is adjusted such that liquid is contained within the liquid reservoir 334 as long as the pressure therein is smaller than the predefined level of pressure. The wick 30 pierces the bottom sidewall of the liquid reservoir 334 on its two ends, allowing base liquid to flow from the liquid reservoir 334 through the wick 30 and into the liquid reservoir 334 again, wherein a part of the base liquid following this flow path exits the wick 30 via the pours therein. In this fourth embodiment of the invention, an opening 346 is arranged within the sidewall of the housing 11 of the electronic smoking device 10, which also represents a sidewall of the liquid reservoir 334. Therefore, the opening 346 within the sidewall connects the outside of the electronic smoking device 10 with the interior of the liquid reservoir 334.

In this fourth embodiment of the invention, the pump mechanism 40 comprises a manual pump 344 which is realized as a manual ball pump 344-1. The manual ball pump 344-1 has a squeezable and flexible component 345 which is realized as a squeezable hollow ball. It represents a substantial component of the manual ball pump 344-1 which in this fourth embodiment is only in part arranged within the electronic smoking device 10. The squeezable hollow ball has an opening which is air-tightly connected to the opening 346 within the sidewall of the housing 11 and the liquid reservoir 334. The main part of the squeezable hollow ball is sticking out of the electronic smoking device 10 and can be squeezed from an outside of the electronic smoking device 10. In this fourth embodiment of the invention, the squeezable hollow ball is tightly fixed to the opening 346 and cannot be removed by a user without a destruction of the same or of the electronic smoking device 10 in general. However, it is also possible to realize embodiments of electronic smoking devices 10 in which the squeezable hollow ball is removable from the electronic smoking device 10 without a destruction of the same. For example, a squeezable hollow ball can have a press-fit or a screw-fit connection corresponding to a respective counterpart that is arranged within the opening 346. In such an embodiment, the user can remove the squeezable hollow ball from the electronic smoking device 10 and especially from the liquid reservoir 334 and close the liquid reservoir 334 with for example a plug that corresponds to the opening 346. This assures that the base liquid is maintained within the liquid reservoir 334 when the squeezable hollow ball is removed from the same.

In use, a user who wishes to intensify the taste of the aerosol consumed can simply squeeze or compress the squeezable hollow ball. This will cause the pressure within the liquid reservoir 334 to rise which will squirt base liquid out of the liquid reservoir 334 onto the heating element 28. The heat of the heating element 28 will vaporize the base liquid squirted out of the liquid reservoir 334 which will increase the amount of aerosol produced. Thereby, the taste of the aerosol consumed is intensified.

An electronic smoking device is provided comprising a housing with a mouthpiece portion and a heating element arranged within the housing. Furthermore, the electronic smoking device comprises a liquid reservoir adapted to receive a base liquid therein. Moreover, the electronic smoking device further comprises a pump mechanism that is adapted to provide at least a part of the base liquid within the liquid reservoir onto the heating element upon an actuation of the pump mechanism in a fully assembled state of the electronic smoking device.

An advantage of such an electronic smoking device may be that the vapor production is ameliorated and the taste of the aerosol produced is intensified without that a complicated application of base liquid onto the heating element in a disassembled state of the electronic smoking device is necessary. In more detail, the pump mechanism of the presented electronic smoking device allows to supply base liquid from the liquid reservoir onto the heating element in a fully assembled and closed state of the electronic smoking device and during the usage of the same.

Furthermore preferred, the pump mechanism is adapted to provide a predefined amount of the base liquid from the liquid reservoir onto the heating element upon an actuation of the pump mechanism in a fully assembled state of the electronic smoking device.

In a preferred embodiment, the liquid reservoir has at least one outlet element adapted to permeate base liquid when the pressure within the liquid reservoir surpasses a predefined level of pressure. Preferably, the predefined level of pressure is equal to a predefined difference in the pressure given within the liquid reservoir and the ambient pressure. An advantage of that may be that it is assured that base liquid is only provided from the liquid reservoir onto the heating element upon an actuation of the pump mechanism preventing an undesired leakage of base liquid.

Furthermore preferred, the outlet element is realized as at least one hole within the liquid reservoir, the at least one hole having a diameter which is adjusted such that liquid is contained within the liquid reservoir as long as the pressure therein is smaller than the predefined level of pressure. An advantage of that may be that such an outlet element can cheaply be realized and prevents the base liquid from leaking or dripping out of the liquid reservoir when not desired by the user.

Moreover preferred, the outlet element is realized as a pressure sequence valve. An advantage of such pressure sequence valves may be that they allow a precise adjustment of the predefined level of pressure which needs to be surpassed for a provision of the base liquid from the liquid reservoir.

In a furthermore preferred embodiment, the pump mechanism is at least in part arranged within the housing and adapted to increase the pressure within the liquid reservoir upon an actuation of the pump mechanism. In an even more preferred embodiment, the pump mechanism is fully arranged within the housing and adapted to increase the pressure within the liquid reservoir upon an actuation of the pump mechanism. An advantage of that may be that the electronic smoking device has a compact design and allows base liquid to be squirted from the liquid reservoir onto the heating element without a disassembling of the electronic smoking device being necessary.

Preferably, the pump mechanism comprises a manual pump. An advantage of that may be that the pump mechanism is independent from an external or an internal energy source.

In a preferred embodiment, the pump mechanism comprises at least one squeezable and flexible component, adapted to increase the pressure within the liquid reservoir when squeezed. An advantage of that may be that the pump mechanism can easily be actuated by a deformation of the squeezable and flexible component, causing the pressure within the liquid reservoir to rise and base liquid within the liquid reservoir to exit the same via the outlet element.

Preferably, the housing has at least one opening through which at least a part of the squeezable and flexible component is accessible from an outside of the electronic smoking device. Expressed in other words, the housing preferably has at least one opening through which at least a part of the squeezable and flexible component is accessible from an outside of the electronic smoking device when the electronic smoking device is fully assembled. This enables an easy actuation of the pump mechanism, wherein the amount of manual pressure applied to the squeezable and flexible component by the user can easily be adjusted.

Preferably the housing has at least one opening with a push-button therein which is adapted to deform the squeezable and flexible component upon an actuation of the push-button from an outside of the electronic smoking device. Expressed in other words, the housing has at least one opening with a push-button therein which is adapted to deform the squeezable and flexible component upon an actuation of the push-button from an outside of the electronic smoking device when the electronic smoking device is fully assembled. An advantage of that may be that the electronic smoking device has a handy design and the pump mechanism can easily be actuated.

In a preferred embodiment, the squeezable and flexible component forms a part of the housing and is accessible from an outside of the electronic smoking device. Expressed in other words, the squeezable and flexible component forms a part of the housing and is accessible from an outside of the electronic smoking device when the electronic smoking device is fully assembled. An advantage of that may be that the squeezable and flexible component is easily accessible and the pump mechanism can easily be actuated.

Preferably, the squeezable and flexible component is at least one component of the liquid reservoir. An advantage of that may be that an increase of the pressure within the liquid reservoir can be achieved by a deformation of the liquid reservoir itself. Furthermore, this allows to easily exchange the pump mechanism together with the liquid reservoir.

Moreover preferred, the squeezable and flexible component is a wall of the liquid reservoir. An advantage of that may be that the user of the electronic smoking device can apply a strong force on the squeezable and flexible component since he or she can hold the non-flexible and non-squeezable side of the liquid reservoir in one hand, thereby fixating it, and use the other hand to press or push in the squeezable and flexible wall.

Preferably the whole liquid reservoir is configured flexible and squeezable. In a preferred embodiment, the squeezable and flexible component is made of an elastic material, as for example rubber or the like. An advantage of that may be that the pressure on the base liquid within the liquid reservoir can be increased, since the liquid reservoir can be compressed to a higher degree.

In an even more preferred embodiment, the squeezable and flexible component is a squeezable ball of a manual ball pump. An advantage of that may be that manual ball-pump systems can easily be realized but nevertheless represent efficient and compact pump systems.

Preferably, the ball of the manual ball pump is fully or at least in part enclosed within the housing of the electronic smoking device. An advantage of that may be that the electronic smoking device has a robust and stable design.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

10 electronic smoking device
11 housing
12 battery portion
13 mouthpiece portion
14 atomizer/liquid reservoir portion
16 end cap
18 battery
20 light-emitting diode (LED)
22 control electronics
24 airflow sensor
26 atomizer
28 heating element
30 wick
31, 331 air passage
32 central passage
34, 134, 234, 334 liquid reservoir
36 air inhalation port
38 air inlets
40, 140, 240, 340 pump mechanism
42, 142, 242, 342 outlet element
42-1, 342-1 at least one hole
42-2, 142-2, 242-2 pressure sequence valve
44, 144, 244, 344 manual pump
45, 145, 245, 345 squeezable and flexible component
46, 346 opening
48 push-button
50 first compartment
52 second compartment
54 channel
55 cut out corner
244-1, 344-1 ball pump

The invention claimed is:

1. An electronic smoking device, comprising
a housing with a mouthpiece portion;
a heating element arranged within the housing;
a liquid reservoir adapted to receive a base liquid therein;
a wick connected between the liquid reservoir and the heating element, the wick configured and arranged to allow the base liquid to flow, wherein the heating element is configured and arranged to draw the base liquid from the liquid reservoir via the wick to be vaporized thereby creating an aerosol inhalable by a user; and
a pump mechanism configured and arranged to provide at least a part of the base liquid within the liquid reservoir directly onto the heating element upon an actuation of the pump mechanism without the liquid passing along the wick.

2. The electronic smoking device of claim 1, wherein the liquid reservoir has at least one outlet element configured and arranged to permeate base liquid when the pressure within the liquid reservoir surpasses a predefined level of pressure.

3. The electronic smoking device of claim 2, wherein the outlet element includes at least one hole within the liquid reservoir, the at least one hole having an adjustable diameter configured and arranged such that liquid is contained within the liquid reservoir as long as the pressure within the liquid reservoir is smaller than the predefined level of pressure.

4. The electronic smoking device of claim 2, wherein the outlet element is a pressure sequence valve.

5. The electronic smoking device of claim 1, wherein the pump mechanism is at least in part arranged within the housing and configured to increase the pressure within the liquid reservoir in response to an actuation of the pump mechanism.

6. The electronic smoking device of claim 1, wherein the pump mechanism comprises a manual pump.

7. The electronic smoking device of claim 1, wherein the liquid reservoir is configured and arranged to be squeezed by a user and to flex in response thereto.

8. The electronic smoking device of claim 7, wherein the liquid reservoir is further configured and arranged to increase the pressure within the liquid reservoir in response to the user squeeze and to deliver a portion of the base liquid onto the heating element.

9. The electronic smoking device of claim 1, wherein the pump mechanism is in fluid communication between the liquid reservoir and the heating element.

10. An electronic smoking device, comprising
a housing with a mouthpiece portion;
a heating element arranged within the housing;
a liquid reservoir arranged within the housing, and adapted to receive a base liquid therein; and
a pump mechanism adapted to provide at least a part of the base liquid within the liquid reservoir onto the heating element upon an actuation of the pump mechanism;
wherein the pump mechanism is configured and arranged in response to actuation of the pump mechanism to increase pressure therein and draw a portion of the base liquid within the pump mechanism into contact with the heating element, and in response to de-actuation of the pump mechanism to draw a vacuum therein that induces the base liquid to flow from the liquid reservoir into the pump mechanism.

11. An electronic smoking device, comprising
a housing with a mouthpiece portion;
a heating element arranged within the housing;
a liquid reservoir adapted to receive a base liquid therein; and
a pump mechanism adapted to provide at least a part of the base liquid within the liquid reservoir onto the heating element upon an actuation of the pump mechanism;
wherein the pump mechanism is a squeezable ball of a manual ball pump and is in fluid communication between the liquid reservoir and the heating element, and wherein the manual ball pump is configured and arranged in response to repeated user actuation and release to cycle a pressure within the squeezable and flexible component between positive and negative pressures thereby drawing a portion of the base liquid from the liquid reservoir into contact with the heating element.

12. The electronic smoking device of claim 11, wherein the ball of the manual ball pump is fully or at least in part enclosed within the housing of the electronic smoking device.

13. An electronic smoking device, comprising:
a housing with a mouthpiece portion;
a heating element arranged within the housing;
a liquid reservoir adapted to receive a base liquid therein; and a pump mechanism adapted to provide at least a part of the base liquid within the liquid reservoir directly onto the heating element upon an actuation of the pump mechanism;

wherein the pump mechanism comprises at least one squeezable and flexible component, the pump mechanism configured and arranged in response to a user squeezing the at least one squeezable and flexible component to increase the pressure within the liquid reservoir;

wherein the housing has at least one opening configured and arranged to facilitate external user access and manipulation of at least a part of the at least one squeezable and flexible component.

14. The electronic smoking device of claim 13, wherein that at least one opening includes a push-button therein, the push-button configured and arranged to deform the at least one squeezable and flexible component in response to an actuation of the push-button by the user.

15. The electronic smoking device of claim 13, wherein the at least one squeezable and flexible component forms a part of the housing and is configured and arranged to be externally accessible by the user from an outside of the electronic smoking device.

16. The electronic smoking device of claim 13, wherein the at least one squeezable and flexible component is at least one component of the liquid reservoir.

17. The electronic smoking device of claim 16, wherein the at least one squeezable and flexible component is a wall of the liquid reservoir.

* * * * *